US010141641B2

(12) United States Patent
Huang et al.

(10) Patent No.: US 10,141,641 B2
(45) Date of Patent: Nov. 27, 2018

(54) DUAL BAND ANTENNA APPARATUS AND DUAL BAND ANTENNA MODULE

(71) Applicant: PEGATRON CORPORATION, Taipei (TW)

(72) Inventors: Jung-Yi Huang, Taipei (TW); Ke-Chang Huang, Taipei (TW); Yi-Jung Huang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 90 days.

(21) Appl. No.: 15/436,335

(22) Filed: Feb. 17, 2017

(65) Prior Publication Data

US 2017/0264016 A1 Sep. 14, 2017

(30) Foreign Application Priority Data

Mar. 8, 2016 (TW) ..... 105106979 A

(51) Int. Cl.
*H01Q 5/30* (2015.01)
*H01Q 1/36* (2006.01)
(Continued)

(52) U.S. Cl.
CPC ..... *H01Q 5/30* (2015.01); *H01Q 1/36* (2013.01); *H01Q 1/38* (2013.01); *H01Q 1/48* (2013.01);
(Continued)

(58) Field of Classification Search
CPC ..... H01Q 5/30; H01Q 5/371; H01Q 1/36; H01Q 1/38; H01Q 1/48; H01Q 7/00; H01Q 9/42; H01Q 21/205
See application file for complete search history.

(56) References Cited

U.S. PATENT DOCUMENTS 8,134,517 B2 3/2012 Wang et al.
9,270,014 B2 2/2016 Lin
(Continued)

FOREIGN PATENT DOCUMENTS

CN 105048053 11/2015
TW 201017978 5/2010
(Continued)

OTHER PUBLICATIONS

"Office Action of Taiwan Counterpart Application," dated Jul. 11, 2017, p. 1-p. 4.

*Primary Examiner* — Graham Smith
(74) *Attorney, Agent, or Firm* — J.C. Patents

(57) ABSTRACT

A dual band antenna apparatus including a heat sink and a dual band antenna is provided. The heat sink is disposed on the dual band antenna. The dual band antenna includes a first radiator and a second radiator. The first radiator and the heat sink are oppositely disposed. The first radiator has a first open terminal, a first ground terminal and a feeding point. The first radiator receives a feeding signal through the feeding point to generate a first resonance mode, and thus the dual band antenna is capable of receiving or sending and both a first band signal. The second radiator is connected to the heat sink and has a second open terminal and a second ground terminal. The second open terminal of the second radiator is coupled with the first radiator and excited to generate a second resonance mode, thus the dual band antenna is capable of receiving or sending and both a second band signal.

23 Claims, 4 Drawing Sheets

(51) Int. Cl.

| | |
|---|---|
| ***H01Q 1/38*** | (2006.01) |
| ***H01Q 1/48*** | (2006.01) |
| ***H01Q 7/00*** | (2006.01) |
| ***H01Q 9/42*** | (2006.01) |
| ***H01Q 21/20*** | (2006.01) |
| ***H01Q 5/371*** | (2015.01) |

(52) U.S. Cl.
CPC ..... *H01Q 5/371* (2015.01); *H01Q 7/00* (2013.01); *H01Q 9/42* (2013.01); *H01Q 21/205* (2013.01)

(56) References Cited

U.S. PATENT DOCUMENTS

| | | | |
|---|---|---|---|
| 2010/0103069 | A1 | 4/2010 | Wang et al. |
| 2014/0062798 | A1 | 3/2014 | Lin |

FOREIGN PATENT DOCUMENTS

| | | |
|---|---|---|
| TW | 201409825 | 3/2014 |
| TW | I514678 | 12/2015 |

DUAL BAND ANTENNA APPARATUS AND DUAL BAND ANTENNA MODULE

CROSS-REFERENCE TO RELATED APPLICATION

This application claims the priority benefit of Taiwan application serial no. 105106979, filed on Mar. 8, 2016. The entirety of the above-mentioned patent application is hereby incorporated by reference herein and made a part of this specification.

BACKGROUND

Technology Field

The disclosure relates to an antenna apparatus, and particularly relates to a dual band antenna apparatus and a dual band antenna module.

Related Art

Along with development of technology, applications of communication technology in science and technology products are increased day by day, such that related communication products also become more diversified, and electronic apparatuses having a wireless transmission function have become indispensable products in daily life. In recent years, consumers' demand on functions of the communication products becomes increasingly high, so that communication products with different designs and different functions are continually provided. In the communication product, a main function of an antenna is to send and receive signals, and how to make the antenna to receive and send signals of a plurality of frequency bands, for example, to provide a dual band antenna, a three-band antenna and apply the same to the communication products, etc., have become a hot trend in recent years.

SUMMARY

The disclosure is directed to a dual band antenna apparatus and a dual band antenna module, in which signals of two different frequency bands are received and sent through a dual band antenna, and a heat sink is configured in the dual band antenna to effectively assist the dual band antenna apparatus or the dual band antenna module to dissipate heat without influencing an antenna performance.

The disclosure provides a dual band antenna apparatus including a heat sink and a dual band antenna, the heat sink is disposed on the dual band antenna. The dual band antenna includes a first radiator and a second radiator. The first radiator and the heat sink are disposed opposite to each other. The first radiator has a first open terminal, a first ground terminal and a feeding point. The first radiator receives a feeding signal through the feeding point to generate a first resonance mode, and thus the dual band antenna is capable of receiving or sending and both a first band signal. The second radiator is connected to the heat sink and has a second open terminal and a second ground terminal. The second open terminal of the second radiator is coupled to the first radiator, and is excited to generate a second resonance mode, and thus the dual band antenna is capable of receiving or sending and both a second band signal.

In an embodiment of the disclosure, the second radiator includes a first radiation element and a second radiation element. One end of the first radiation element is connected to the heat sink, and another end thereof is the second open terminal of the second radiator. One end of the second radiation element is connected to the first radiation element, and another end thereof is the second ground terminal of the second radiator for connecting a ground, and thus the first radiation element and the second radiation element are adapted to provide a resonance path.

In an embodiment of the disclosure, the first radiation element and the second radiation element form a loop antenna.

In an embodiment of the disclosure, the first radiation element presents an "L" shape.

In an embodiment of the disclosure, the dual band antenna is disposed at a periphery of the heat sink.

In an embodiment of the disclosure, the heat sink further includes an opening, and the opening is set corresponding to the dual band antenna, the second radiator is connected to a side of the opening, and a projection of the first radiator on a plane on which the opening is located is within the opening.

In an embodiment of the disclosure, the dual band antenna apparatus further includes a substrate, where the substrate is disposed at a side of the heat sink, the first radiator is disposed on the substrate, and the second ground terminal of the second radiator is connected to the ground through the substrate.

In an embodiment of the disclosure, the substrate includes a ground surface and an insulating area corresponding to the second radiator, the first radiator is located in the insulating area, and the second ground terminal of the second radiator is connected to the ground through the ground surface.

In an embodiment of the disclosure, the first radiator includes a radiation element and a connection section. One end of the radiation element is the first open terminal of the first radiator, and another end thereof is the feeding point of the first radiator. One end of the connection section is connected to the radiation element, and another end thereof is the first ground terminal of the first radiator, and the connection section is connected to the ground surface through the first ground terminal.

In an embodiment of the disclosure, the second open terminal of the second radiator is coupled to the first open terminal of the radiation element, and a distance between the first open terminal of the radiation element and the second open terminal of the second radiator ranges between 0.5 mm and 1 mm.

In an embodiment of the disclosure, the substrate is a printed circuit board.

The disclosure provides a dual band antenna module including a heat sink and a plurality of dual band antennas. The heat sink is disposed on the dual band antennas, where each of the dual band antennas includes a first radiator and a second radiator. The first radiator and the heat sink are disposed opposite to each other. The first radiator has a first open terminal, a first ground terminal and a feeding point. The first radiator receives a feeding signal through the feeding point to generate a first resonance mode, and thus the dual band antenna is capable of receiving or sending and both a first band signal. The second radiator is connected to the heat sink and has a second open terminal and a second ground terminal. The second open terminal of the second radiator is coupled to the corresponding first radiator, and is excited to generate a second resonance mode, and thus the dual band antenna is capable of receiving or sending and both a second band signal.

In an embodiment of the disclosure, the second radiator includes a first radiation element and a second radiation element. One end of the first radiation element is connected to the heat sink, and another end thereof is the second open terminal of the second radiator. One end of the second radiation element is connected to the first radiation element, and another end thereof is the second ground terminal of the second radiator for connecting a round, and thus the first radiation element and the second radiation element are adapted to provide a resonance path.

In an embodiment of the disclosure, the first radiation element and the second radiation element form a loop antenna.

In an embodiment of the disclosure, the first radiation element presents an "L" shape.

In an embodiment of the disclosure, the dual band antennas are disposed at a periphery of the heat sink.

In an embodiment of the disclosure, the dual band antenna module further includes a plurality of parasitic elements disposed at a periphery of the heat sink, and the parasitic elements are respectively located between two dual band antennas, and one end of each of the parasitic elements is connected to the heat sink, and another end thereof is a third open terminal.

In an embodiment of the disclosure, the heat sink further includes a plurality of openings, and the openings are set corresponding to the dual band antennas, each of the second radiators is connected to a side of the corresponding opening, and a projection of each of the first radiators on a plane on which the corresponding opening is located is within the corresponding opening.

In an embodiment of the disclosure, the dual band antenna apparatus further includes a substrate, where the substrate is disposed at a side of the heat sink, the first radiator of each of the dual band antennas is disposed on the substrate, and the second ground terminal of the second radiator of each of the dual band antennas is connected to the ground through the substrate.

In an embodiment of the disclosure, the substrate includes a ground surface and a plurality of insulating areas, and each of the insulating areas is disposed corresponding to the second radiator of each of the dual band antennas, and the first radiator of each of the dual band antennas is located in each of the corresponding insulating areas, and the second ground terminal of each of the second radiators is connected to the ground through the ground surface.

In an embodiment of the disclosure, each of the first radiators includes a radiation element and a connection section. One end of the radiation element is the first open terminal of the first radiator, and another end thereof is the feeding point of the first radiator. One end of the connection section is connected to the radiation element, and another end thereof is the first ground terminal of the corresponding first radiator, and the connection section is connected to the ground surface through the first ground terminal.

In an embodiment of the disclosure, the second open terminal of each of the second radiators is coupled to the first open terminal of the corresponding radiation element, and a distance between the second open terminal of each of the second radiators and the first open terminal of the corresponding radiation element ranges between 0.5 mm and 1 mm.

In an embodiment of the disclosure, the substrate is a printed circuit board.

According to the above description, in the embodiment of the disclosure, the second radiator is coupled to the first radiator serving as an excitation source, such that the dual band antenna is capable of receiving or sending and both the first band signal and the second band signal. The heat sink is disposed on the dual band antenna, and the second radiator is connected to the heat sink, in this way, the heat sink may effectively assist the dual band antenna apparatus or the dual band antenna module to dissipate heat without influencing an antenna performance.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF EMBODIMENTS

Figure 1:
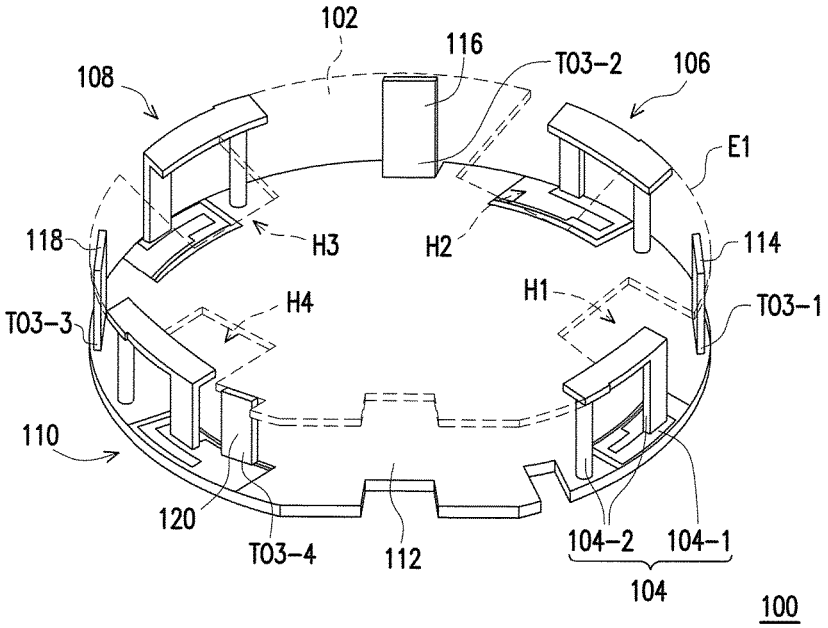
FIG. 1 is a schematic diagram of a dual band antenna module according to an embodiment of the disclosure.

Referring to FIG. 1, FIG. 1 is a schematic diagram of a dual band antenna module according to an embodiment of the disclosure. The dual band antenna module 100 includes a heat sink 102, a plurality of dual band antennas 104, 106, 108, 110, a substrate 112 and a plurality of parasitic elements 114, 116, 118, 120. In order to clearly show the structure of the dual band antenna module 100, the heat sink 102 is indicated by dot lines, and the heat sink 102 can be implemented by a metal conductive material such as aluminium, copper, stainless steel, etc. the dual band antennas 104, 106, 108 and 110 are disposed at a periphery μl of the heat sink 102, and the parasitic elements 114, 116, 118 and 120 are also disposed at the periphery μl of the heat sink 102, and the parasitic elements 114, 116, 118 and 120 are respectively located between two dual band antennas. The substrate 112 is disposed at a side of the heat sink 102, and in the present embodiment, the substrate 112 is, for example, disposed under the heat sink 102, though the disclosure is not limited thereto. The substrate 112 can be a printed circuit board, though the disclosure is not limited thereto.

Each of the dual band antennas 104, 106, 108, 110 respectively includes a first radiator 104-1 and a second radiator 104-2. Each of the first radiators 104-1 and the heat sink 102 are disposed opposite to each other, and the heat sink 102 has a plurality of openings H1, H2, H3, H4, and the openings H1, H2, H3, H4 respectively correspond to the dual band antennas 104, 106, 108 and 110. In order to keep the figure simple, only the first radiator 104-1 and the second radiator 104-2 of the dual band antenna 104 are taken as an example for description, and device configuration and actuation relationship of the other dual band antennas 106, 108 and 110 are all the same with that of the first radiator 104-1 and the second radiator 104-2 of the dual band antenna 104. The second radiator 104-2 is connected to the heat sink 102, and the second radiator 104-2 is connected to a side of the corresponding opening H1, and a projection of the first radiator 104-1 on a plane on which the corresponding opening H1 is located is within the opening H1. The first radiator 104-1 has a first open terminal TO1, a first ground terminal TG1 and a feeding point F1. The first radiator 104-1 receives a feeding signal through the feeding point F1 to generate a first resonance mode, and thus the dual band antenna 104 is capable of receiving or sending and both a first band signal. In the present embodiment, the first band signal can be a signal with a frequency band between 5.15 GHz and 5.85 GHz, and a first radiation element presents an "L" shape, though the disclosure is not limited thereto. In the present embodiment, the second radiator 104-2 is coupled to the first radiator 104-1, and the first radiator 104-1 serves as an excitation source to excite the second radiator 104-2, and the second radiator 104-2 is excited to generate a second resonance mode, and thus the dual band antenna 104 is capable of receiving or sending and both a second band signal, where the second band signal can be a signal with a frequency band between 2400 MHz and 2500 MHz, though the disclosure is not limited thereto. It should be noted that in the present embodiment, although the frequency band provided by the second radiator 104-2 is lower than the frequency band provided by the first radiator 104-1, the disclosure is not limited thereto, and in other embodiments, the frequency band provided by the second radiator 104-2 can also be designed to be higher than the frequency band provided by the first radiator 104-1.

Figure 2:
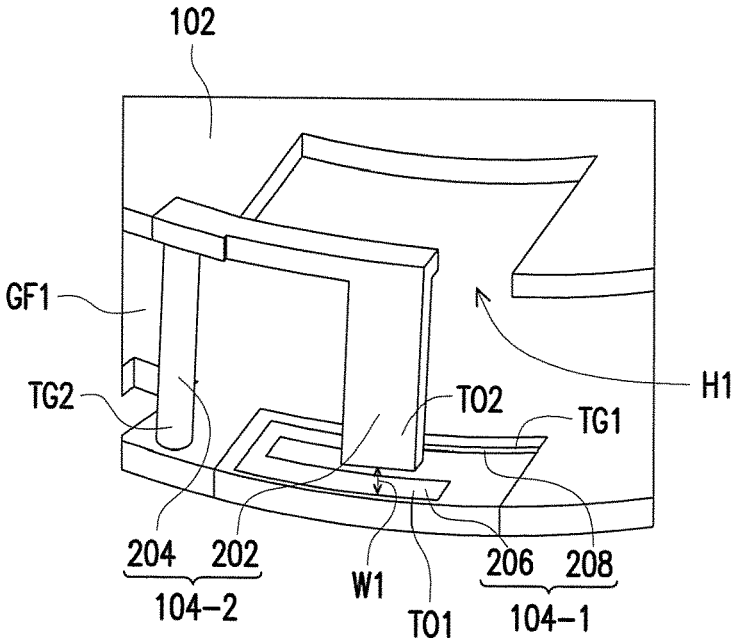
FIG. 2 is a schematic diagram of the dual band antenna according to the embodiment of FIG. 1.

Referring to FIG. 2, FIG. 2 is a schematic diagram of the dual band antenna 104 according to the embodiment of FIG. 1. Further, the second radiator 104-2 of the dual band antenna 104 has a second open terminal TO2 and a second ground terminal TG2, where the second open terminal TO2 of the second radiator 104-2 is coupled to the first radiator 104-1. Further, the second radiator 104-2 may include a first radiation element 202 and a second radiation element 204, where one end of the first radiation element 202 is connected to the heat sink 102, and another end of the first radiation element 202 is the second open terminal TO2 of the second radiator 104-2. Moreover, one end of the second radiation element 204 is connected to the first radiation element 202, and another end of the second radiation element 204 is the second ground terminal TG2 of the second radiator 104-2. The second radiation element 204 is connected to the ground through the second ground terminal TG2, and thus the first radiation element 202 and the second radiation element 204 to provide a resonance path. The ground can be a ground voltage. In the present embodiment, the first radiation element 202 and the second radiation element 204 form a loop antenna, and by coupling the second open terminal TO2 of the first radiation element 202 with the first radiator 104-1, the dual band antenna 104 is capable of receiving or sending and both the second band signal. Moreover, the second radiation element 204 may also prevent high voltage static electricity from suddenly entering other circuit devices from the heat sink 102 to cause damage.

Figure 3:
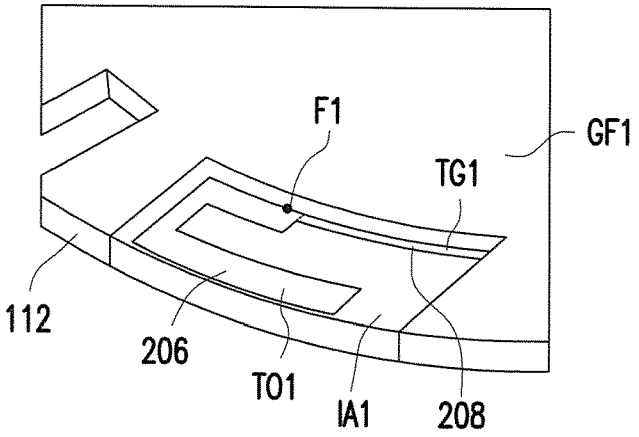
FIG. 3 is a schematic diagram of a first radiator according to an embodiment of the disclosure.
Figure 4:
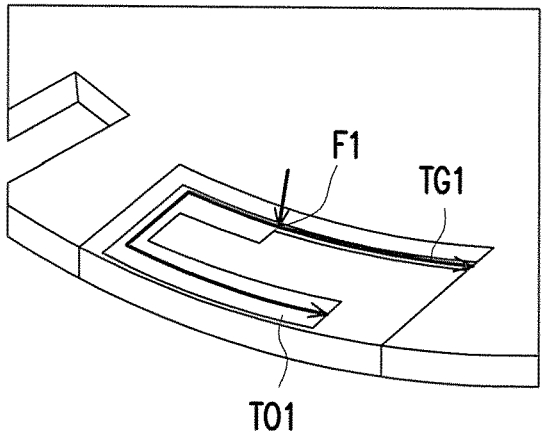
FIG. 4 is a surface current distribution diagram of a first radiator according to an embodiment of the disclosure.
Figure 5:
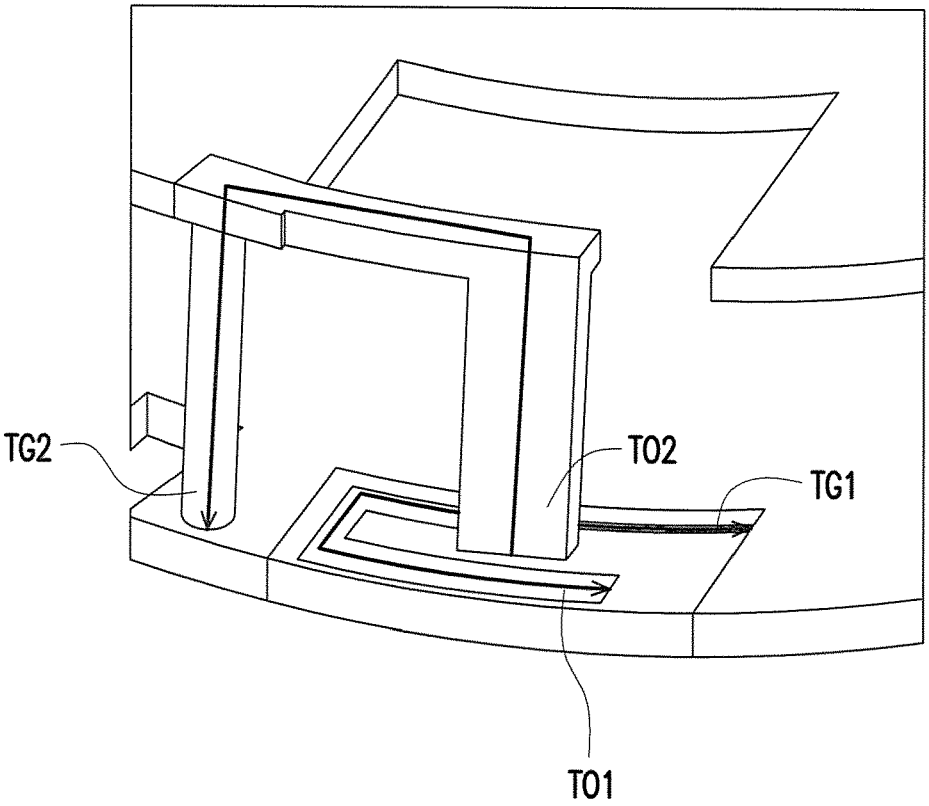
FIG. 5 is a surface current distribution diagram of a second radiator excited by the first radiator according to an embodiment of the disclosure.

Then, an implementation of the first radiator 104-1 is shown in FIG. 3, and in order to facilitate describing the implementation of the first radiator 104-1, only the first radiator 104-1 and the substrate 112 are illustrated in FIG. 3, where the substrate 112 includes a ground surface GF1 and an insulating area IA1. The insulating area IA1 is disposed corresponding to the second radiator 104-2, and the first radiator 104-1 is disposed on the substrate 112 and is located in the insulating area IA1, and the second ground terminal TG2 of the second radiator 104-2 is connected to the ground through the ground surface GF1 (shown in FIG. 2). In the present embodiment, the substrate 112 is a printed circuit board, and the ground surface GF1 can be a metal layer on the surface of the printed circuit board, and the insulating area IA1 is an insulating surface area of the printed circuit board exposed after the metal layer on the surface of the printed circuit board is removed. The first radiator 104-1 may include a radiation element 206 and a connection section 208. One end of the radiation element 206 is the first open terminal TO1 of the first radiator 104-1, and another end of the radiation element 206 is the feeding point F1 of the first radiator 104-1. One end of the connection section 208 is connected to the radiation element 206, and another end of the connection section 208 is the first ground terminal TG1 of the first radiator 104-1, and the connection section 208 is connected to the ground surface GF1 through the first ground terminal TG1, and is connected to the ground through the ground surface GF1. The first radiator 104-1 may receive a feeding signal through the feeding point F1 to generate the first resonance mode, and thus the dual band antenna 104 is capable of receiving or sending and both the first band signal, and the first radiator 104-1 can be coupled to the second radiator 104-2 to excite the second radiator 104-2 to generate the second resonance mode, and thus the dual band antenna 104 is capable of receiving or sending and both the second band signal. The second open terminal TO2 of the second radiator 104-2 is coupled to the first open terminal TO1 of the radiation element 206 of the first radiator 104-1. A distance W1 between the first open terminal TO1 of the radiation element 206 and the second open terminal TO2 of the second radiator 104-2 ranges between 0.5 mm and 1 mm. In the present embodiment, the second open terminal TO2 of the second radiator 104-2 is located above the radiation element 206, though the disclosure is not limited thereto. A surface current distribution of the first radiator 104-1 when the first radiator 104-1 generates the first resonance mode is shown as FIG. 4, and after the feeding signal is fed from the feeding point F1, the generated surface current flows to the first open terminal TO1 of the radiation element 206 from the feeding point F1, and flows to the first ground terminal TG1 of the radiation element 206 from the feeding point F1 (as shown by arrows). A surface current distribution of the second radiator 104-2 when the second radiator 104-2 is excited by the first radiator 104-1 to generate the second resonance mode is shown as FIG. 5, and the surface current flows to the second ground terminal TG2 of the second radiator 104-2 from the second open terminal TO2 of the second radiator 104-2 (as shown by an arrow).

Implantations of the dual band antennas 106, 108 and 110 are the same with that of the dual band antenna 104, and those skilled in the art may learn implementation details of the dual band antennas 106, 108 and 110 according to related description of the aforementioned embodiment, and detail thereof is not repeated. A designer may adjust the first band signal and the second band signal received and sent by each of the dual band antennas according to an actual requirement. For example, the first band signal received and sent by the dual band antenna is adjusted by adjusting a length of the radiation element of the first radiator. Similarly, the second band signal received and sent by the dual band antenna can be adjusted by adjusting a length of the first radiation element of the second radiator.

Moreover, in order to effectively avoid mutual influence of the dual band antennas 104, 106, 108 and 110, as shown in FIG. 1, the parasitic elements 114, 116, 118 and 120 can be respectively disposed between two dual band antennas to effectively avoid the mutual influence of the dual band antennas 104, 106, 108 and 110, so as to achieve the best signal transmission effect. The parasitic element 114 is located between the dual band antennas 104 and 106, the parasitic element 116 is located between the dual band antennas 106 and 108, the parasitic element 118 is located between the dual band antennas 108 and 110, and the parasitic element 120 is located between the dual band antennas 110 and 104. One ends of the parasitic elements 114, 116, 118 and 120 are connected to the heat sink 102, and the other end of the parasitic elements 114, 116, 118 and 120 are respectively the third open terminals TO3-1, TO3-2, TO3-3 and TO3-4.

Figure 6:
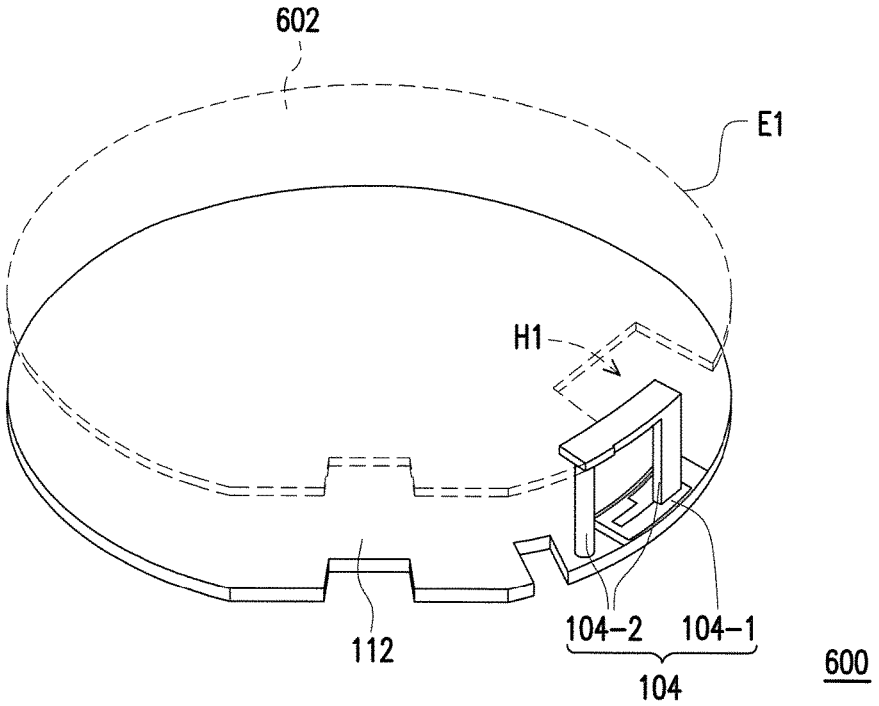
FIG. 6 is a schematic diagram of a dual band antenna apparatus according to an embodiment of the disclosure.

It should be noted that in other embodiments, as shown in FIG. 6, FIG. 6 is a schematic diagram of a dual band antenna apparatus 600 according to an embodiment of the disclosure. A difference between the dual band antenna apparatus 600 and the dual band antenna module 100 of the embodiment of FIG. 1 is that the dual band antenna apparatus 600 only includes a heat sink 602 and a dual band antenna 104, and compared to the heat sink 102 of the embodiment of FIG. 1, the opening of the heat sink 602 corresponding to the dual band antenna 104 only has the opening H1. The implementation of the dual band antenna 104 has been described in the aforementioned embodiment, and detail thereof is not repeated. It should be noted that since the embodiment of FIG. 6 only includes one dual band antenna 104, the problem of mutual influence between a plurality of dual band antennas does not exist, and the parasitic elements 114, 116, 118 and 120 of FIG. 1 are unnecessary to be set in the embodiment of FIG. 6.

In summary, in the embodiment of the disclosure, the second radiator is coupled to the first radiator serving as an excitation source, such that the dual band antenna is capable of receiving or sending and both the first band signal and the second band signal. The heat sink is disposed on the dual band antenna, and the second radiator is connected to the heat sink, in this way, the heat sink may effectively assist the dual band antenna apparatus or the dual band antenna module to dissipate heat without influencing an antenna performance. Moreover, the parasitic elements can be respectively disposed between the dual band antennas to effectively avoid the mutual influence of the dual band antennas, so as to achieve the best signal transmission effect.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A dual band antenna apparatus, comprising:

a heat sink; and a dual band antenna, the heat sink being disposed on the dual band antenna, and the dual band antenna comprising:

a first radiator, disposed opposite to the heat sink, and having a first open terminal, a first ground terminal and a feeding point, wherein the first radiator receives a feeding signal through the feeding point to generate a first resonance mode, and thus the dual band antenna is capable of receiving or sending and both a first band signal; and a second radiator, connected to the heat sink, and having a second open terminal and a second ground terminal, wherein the second open terminal of the second radiator is coupled to the first radiator, and is excited to generate a second resonance mode, and thus the dual band antenna is capable of receiving or sending and both a second band signal.

2. The dual band antenna apparatus as claimed in claim 1, wherein the second radiator comprises:

a first radiation element, having one end connected to the heat sink, and another end being the second open terminal of the second radiator; and a second radiation element, having one end connected to the first radiation element, and another end being the second ground terminal of the second radiator for connecting a ground, and thus the first radiation element and the second radiation element are adapted to provide a resonance path.

3. The dual band antenna apparatus as claimed in claim 2, wherein the first radiation element and the second radiation element form a loop antenna.

4. The dual band antenna apparatus as claimed in claim 2, wherein the first radiation element presents an "L" shape.

5. The dual band antenna apparatus as claimed in claim 1, wherein the dual band antenna is disposed at a periphery of the heat sink.

6. The dual band antenna apparatus as claimed in claim 1, wherein the heat sink further has an opening, and the opening is set corresponding to the dual band antenna, the second radiator is connected to a side of the opening, and a projection of the first radiator on a plane on which the opening is located is within the opening.

7. The dual band antenna apparatus as claimed in claim 2, further comprising:

a substrate, disposed at a side of the heat sink, wherein the first radiator is disposed on the substrate, and the second ground terminal of the second radiator is connected to the ground through the substrate.

8. The dual band antenna apparatus as claimed in claim 7, wherein the substrate comprises a ground surface and an insulating area corresponding to the second radiator, the first radiator is located in the insulating area, and the second ground terminal of the second radiator is connected to the ground through the ground surface.

9. The dual band antenna apparatus as claimed in claim 8, wherein the first radiator comprises:

a radiation element, having one end being the first open terminal of the first radiator, and another end being the feeding point of the first radiator; and a connection section, having one end being connected to the radiation element, and another end being the first ground terminal of the first radiator, wherein the connection section is connected to the ground surface through the first ground terminal.

10. The dual band antenna apparatus as claimed in claim 9, wherein the second open terminal of the second radiator is coupled to the first open terminal of the radiation element, and a distance between the first open terminal of the radiation element and the second open terminal of the second radiator ranges between 0.5 mm and 1 mm.

11. The dual band antenna apparatus as claimed in claim 8, wherein the substrate is a printed circuit board.

12. A dual band antenna module, comprising:

a heat sink; and a plurality of dual band antennas, wherein the heat sink is disposed on the dual band antennas, and each of the dual band antennas comprises:

a first radiator, disposed opposite to the heat sink, and having a first open terminal, a first ground terminal and a feeding point, the first radiator receives a feeding signal through the feeding point to generate a first resonance mode, and thus the dual band antenna is capable of receiving or sending and both a first band signal; and a second radiator, connected to the heat sink, and having a second open terminal and a second ground terminal, wherein the second open terminal of the second radiator is coupled to the corresponding first radiator, and is excited to generate a second resonance mode, and thus the dual band antenna is capable of receiving or sending and both a second band signal.

13. The dual band antenna module as claimed in claim 12, wherein the second radiator comprises:

a first radiation element, having one end connected to the heat sink, and another end being the second open terminal of the second radiator; and a second radiation element, having one end connected to the first radiation element, and another end being the second ground terminal of the corresponding second radiator for connecting a ground, and thus the first radiation element and the second radiation element are adapted to provide a resonance path.

14. The dual band antenna module as claimed in claim 13, wherein the first radiation element and the second radiation element form a loop antenna.

15. The dual band antenna module as claimed in claim 13, wherein the first radiation element presents an "L" shape.

16. The dual band antenna module as claimed in claim 12, wherein the dual band antennas are disposed at a periphery of the heat sink.

17. The dual band antenna module as claimed in claim 12, further comprising:

a plurality of parasitic elements, disposed at a periphery of the heat sink, and the parasitic elements being respectively located between two dual band antennas, wherein one end of each of the parasitic elements is connected to the heat sink, and another end of each of the parasitic elements is a third open terminal.

18. The dual band antenna module as claimed in claim 12, wherein the heat sink further has a plurality of openings, and the openings are set corresponding to the dual band antennas, each of the second radiators is connected to a side of the corresponding opening, and a projection of each of the first radiators on a plane on which the corresponding opening is located is within the corresponding opening.

19. The dual band antenna module as claimed in claim 13, further comprising:

a substrate, disposed at a side of the heat sink, wherein the first radiator of each of the dual band antennas is disposed on the substrate, and the second ground terminal of the second radiator of each of the dual band antennas is connected to the ground through the substrate.

20. The dual band antenna module as claimed in claim 19, wherein the substrate comprises a ground surface and a plurality of insulating areas, and each of the insulating areas is disposed corresponding to the second radiator of each of the dual band antennas, and the first radiator of each of the dual band antennas is located in each of the corresponding insulating areas, and the second ground terminal of each of the second radiators is connected to the ground through the ground surface.

21. The dual band antenna module as claimed in claim 20, wherein each of the first radiators comprises:

a radiation element, having one end being the first open terminal of the first radiator, and another end being the feeding point of the first radiator; and a connection section, having one end connected to the radiation element, and another end being the first ground terminal of the corresponding first radiator, wherein the connection section is connected to the ground surface through the first ground terminal.

22. The dual band antenna module as claimed in claim 21, wherein the second open terminal of each of the second radiators is coupled to the first open terminal of the corresponding radiation element, and a distance between the second open terminal of each of the second radiators and the first open terminal of the corresponding radiation element ranges between 0.5 mm and 1 mm.

23. The dual band antenna module as claimed in claim 20, wherein the substrate is a printed circuit board.

* * * * *